US010004264B2

(12) United States Patent
Rado

(10) Patent No.: US 10,004,264 B2
(45) Date of Patent: Jun. 26, 2018

(54) VAPORIZER AND DETACHABLE POWER SOURCE

(71) Applicant: Lubby Holdings, LLC, Torrance, CA (US)

(72) Inventor: J. Christian Rado, Torrance, CA (US)

( * ) Notice: Subject to any disclaimer, the term of this patent is extended or adjusted under 35 U.S.C. 154(b) by 0 days. days.

(21) Appl. No.: 15/279,098

(22) Filed: Sep. 28, 2016

(65) Prior Publication Data

US 2017/0086507 A1 Mar. 30, 2017

Related U.S. Application Data

(60) Provisional application No. 62/233,919, filed on Sep. 28, 2015.

(51) Int. Cl.

| | |
|---|---|
| ***A24F 47/00*** | (2006.01) |
| ***H05B 1/02*** | (2006.01) |
| ***H05B 3/44*** | (2006.01) |
| *H01R 13/62* | (2006.01) |

(52) U.S. Cl.

CPC ..... *A24F 47/008* (2013.01); *H05B 1/0244* (2013.01); *H05B 3/44* (2013.01); *H01R 13/6205* (2013.01); *H05B 2203/014* (2013.01); *H05B 2203/021* (2013.01); *H05B 2203/022* (2013.01)

(58) Field of Classification Search

None

See application file for complete search history.

(56) References Cited

U.S. PATENT DOCUMENTS

| | | | |
|---|---|---|---|
| 2,104,266 | A | 1/1938 | McCormick |
| 3,200,819 | A | 8/1965 | Gilbert |
| 4,947,874 | A | 8/1990 | Brooks et al. |
| 7,832,410 | B2 | 11/2010 | Hon |
| 8,156,944 | B2 | 4/2012 | Han |
| 8,365,742 | B2 | 2/2013 | Hon |
| 8,375,957 | B2 | 2/2013 | Hon |
| 8,393,331 | B2 | 3/2013 | Hon |
| 8,794,231 | B2 | 8/2014 | Thorens et al. |
| 8,915,254 | B2 | 12/2014 | Monsees et al. |

(Continued)

OTHER PUBLICATIONS

International Search Report from USPTO dated Dec. 28, 2016 for related International Application No. PCT/US2016/054191.

(Continued)

*Primary Examiner* — Tho D Ta

(74) *Attorney, Agent, or Firm* — Klein, O'Neill & Singh, LLP

(57) ABSTRACT

A vaporizer is configured to receive electric energy from an external power source, and apply that energy to atomize a vaporizing medium disposed within the vaporizer. The vaporizer may be sized and configured to fit within the downstem of a water pipe. A power source receiver is formed on a side of the vaporizer. The power source receiver comprises a first node, a second node electrically insulated relative to the first node, and a magnet. The external power source has an electrical connector that also has electric nodes and a magnet. When the power source connector is arranged adjacent the power source receiver, the opposing magnets attract one another, pulling the power source and vaporizer into properly-aligned contact so that the nodes are engaged. As such, the external power source can provide power to operate the vaporizer.

22 Claims, 7 Drawing Sheets

(56) References Cited

U.S. PATENT DOCUMENTS

| | | | | |
|---|---|---|---|---|
| 9,220,303 | B2 | 12/2015 | Li et al. | |
| 9,364,024 | B2 | 6/2016 | Liu | |
| 9,380,811 | B2 | 7/2016 | Chung | |
| 9,675,111 | B2 * | 6/2017 | Ellis | A24F 47/008 |
| 2013/0152922 | A1 | 6/2013 | Benassayag et al. | |
| 2013/0247910 | A1 | 9/2013 | Postma | |
| 2013/0298905 | A1 | 11/2013 | Levin et al. | |
| 2014/0041655 | A1 * | 2/2014 | Barron | A61M 11/042 128/202.21 |
| 2015/0257443 | A1 * | 9/2015 | Rado | A24F 47/00 392/390 |
| 2015/0282524 | A1 | 10/2015 | Elhalwani | |
| 2016/0029696 | A1 | 2/2016 | Obeidallah | |
| 2016/0249677 | A1 | 9/2016 | Bishara | |
| 2017/0055579 | A1 * | 3/2017 | Kuna | A24F 47/008 |

OTHER PUBLICATIONS

Written Opinion from USPTO dated Dec. 28, 2016 for related International Application No. PCT/US2016/054191.

* cited by examiner

VAPORIZER AND DETACHABLE POWER SOURCE

CROSS-REFERENCE TO RELATED APPLICATIONS

The application claims priority from U.S. Provisional Application No. 62/233,919, which was filed Sep. 28, 2015, the entirety of which is hereby incorporated by reference.

BACKGROUND

The present disclosure relates to the field of apparatus and methods for vaporizing essential oils, e-liquids and waxes.

A vaporizer is a device used to vaporize a vaporizing medium for the purpose of inhalation. Vaporization is an alternative to burning (smoking) that avoids the inhalation of many irritating toxic and carcinogenic by-products. In some forms, the media that is vaporized is an extract of plant material in the form of an oil or a wax. Some vaporizers, such as electronic cigarettes, vaporize e-liquids, which are liquid solutions that typically include chemicals such as one or more of propylene glycol, glycerin, and polyethylene glycol 400, often combined with tobacco-derived nicotine.

In some vaporization processes, the vaporizing medium is vaporized in a water pipe. The user may use a handheld blowtorch to heat a metal surface until the metal surface reaches a desired temperature, which may be indicated by a glowing orange hue. The user then places a drop of vaporizing medium on the hot surface with an implement, such as a glass rod or a dental pick. The media then melts, boils, and is atomized, forming a vapor when the atomized medium is entrained in surrounding air. The user then inhales through the water pipe to draw the vapor into the user's lungs. This process is not only cumbersome, but also potentially dangerous, since it involves use of a handheld blowtorch and an exposed, glowing hot titanium surface. Some vaporizers incorporate a heating element, such as a flame-based or electricity-based heating element. However, such self-contained vaporizers may be complex and bulky for use with water pipes.

SUMMARY

There is a need in the art for a simpler and safer alternative for vaporizing essential oils and waxes.

In some embodiments, the present specification provides a vaporizer having a power receiver formed on a housing of vaporizer, and an external power supply is releasably connectable to the power receiver. Power from the power supply is communicated to the vaporizer through the power receiver. In some such embodiments, the external power supply is selectively magnetically retained in engagement with the power receiver.

In accordance with one embodiment, the present specification provides a vaporizing apparatus, comprising a tubular housing having a proximal end and a distal end, and an atomizer cup arranged within the housing. The atomizer cup comprises a heating element and opens toward the proximal end of the housing, and the heating element has a first end and a second end. A vapor path is defined within the housing between the atomizer cup and the distal end. A power source receiver is arranged on the housing, and has a first node and a second node that are electrically insulated relative to one another. The first node is electrically connected to the first end of the heating element, and the second node is electrically connected to the second end of the heating element.

The power source receiver additionally comprises a magnet. A power wand comprises a battery and a wand connector. The wand connector has a first wand node, a second wand node, an insulator electrically insulating the first wand node relative to the second wand node, and a wand magnet having a polarity opposite a polarity of the power source receiver magnet. The first wand node electrically communicates with a first pole of the battery. The second wand node electrically communicates with a second pole of the battery. The first and second poles have opposite polarity. The wand connector is configured to fit complementarily onto the power source receiver so that the power source receiver magnet and the wand magnet hold the wand connector in place on the power connector so that the first wand node engages the first node and the second wand node engages the second node. When the wand connector is fit onto the power source receiver, the heating element is energized.

In some embodiments, a tapered part of the housing has a tapered outer diameter that decreases moving toward the distal end of the housing. In additional embodiments, a proximal portion of the housing has an outer diameter greater than an outer diameter of a distal portion of the housing, and the tapered part is in the distal portion of the housing.

Further embodiments are configured for use in connection with a water pipe having a downstem with a downstem inner diameter, wherein a first portion of the tapered part has a diameter less than the downstem inner diameter and a second portion of the tapered part has a diameter greater than or equal to the downstem inner diameter. The tapered part engages an inner surface of the downstem and some of the tapered part extends into the downstem.

Some embodiments additionally comprise a controller configured to control power delivery to the heating element. In some such embodiments, the controller is configured to prevent energizing of the heating element beyond an elapsed time. In other embodiments, the controller is configured so that a user can select between a plurality of control modes by actuating an interface. In yet further embodiments, the controller is disposed within one of the vaporizer and power wand. In yet additional embodiments, in a first mode the controller is configured to energize the heating elements for a specified time period when the actuator button is actuated.

Yet additional embodiments additionally comprise a lid configured to be removably attached to the proximal end of the housing so as to define a vaporizing chamber between the lid and the heating surface when the lid is attached.

In still further embodiments, the power source receiver is formed on a side wall of the vaporizer housing.

In accordance with another embodiment, the present specification provides a method of using a vaporizing apparatus, comprising placing a vaporizing medium on a heating surface of an atomizer cup arranged in a tubular housing of the vaporizing apparatus, placing the vaporizing apparatus into a downstem of a water pipe so that a portion of the tubular housing of the vaporizing apparatus extends into the downstem and a portion of the tubular housing engages an inner surface of the downstem, engaging a separately-formed power wand with a wand receiver formed on the housing so that power from the power wand is communicated to the atomizer cup, and drawing a vapor along a vapor path from the heating surface, through the tubular housing and into the downstem, and further through the water pipe.

Some embodiments additionally comprise leaving the power wand engaged with the wand receiver, and a controller automatically stops delivery of power to the atomizer cup after a specified time.

Additional embodiments comprise positioning the power wand so that it is generally aligned with the wand receiver and releasing the power wand so that magnets on the power wand and wand receiver hold the power wand and wand receiver together so that electrical poles of the power wand and wand receiver are properly aligned so that electric power from the power wand is communicated from the power want through the wand receiver.

DESCRIPTION

Figure 1:
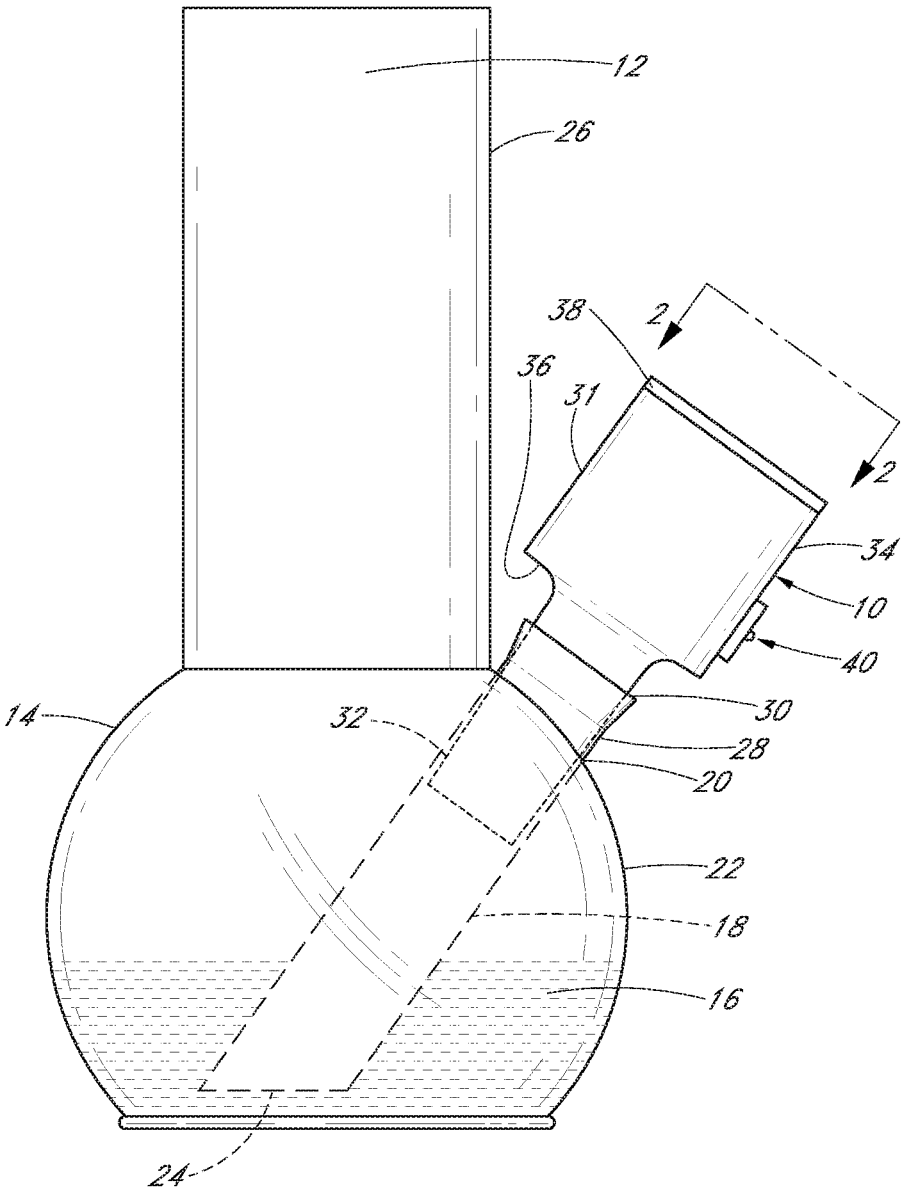
FIG. 1 is a side view of an embodiment of a vaporizer engaged with a water pipe.

With initial reference to FIG. 1, an embodiment of a vaporizing apparatus, or vaporizer 10, is disclosed in conjunction with a typical water pipe 12, which is also commonly referred to as a bong. The water pipe 12 includes a reservoir 14 for holding water 16, a tubular downstem 18 extending through an opening 20 in the sidewall 22 of the reservoir 14, and a tubular stem 26 extending upward from the reservoir 14. A lower or distal opening 24 of the downstem 18 is disposed below the waterline so that the lower opening 24 is submerged in the water 16. An upper or proximal end 28 of the downstem is arranged outside the reservoir 14, and preferably includes an upper or proximal opening 30 which, in the illustrated embodiment, is flared.

During use, vapor from the vaporizing apparatus 10 is drawn through the flared upper opening 30 through the lower opening 24 and into the water 16, from which it is further drawn through the stem 26 before being inhaled by the user. The water 16 in the reservoir 14 filters and cools the vapor from the vaporizing apparatus 10 prior to the vapor passing into the user's lungs, as described in further detail below. The reservoir 14 is typically filled only partially with water 16, with sufficient water 16 being added to submerge the lower opening 24 of the downstem 18 but with a substantial volume of air filling the remainder of the reservoir 14 above the waterline.

With continued reference to FIG. 1, the illustrated vaporizing apparatus comprises a housing 31 having a lower or distal portion 32 and an upper or proximal portion 34. As shown, the upper portion 34 has a greater diameter than the lower portion 32. More specifically, the lower portion 32 is sized so that at least a portion of the lower portion 32 fits through the upper opening 30 of the downstem 18, and extends into the downstem 18, while the upper portion 34 has a diameter greater than that of the downstem 18. A shoulder 36 can be interposed between the proximal and distal portions. While in some embodiments the diameter of the lower portion may be constant, in the illustrated embodiment, a portion of the lower portion 32 is tapered so that part of the lower portion 32 fits into the downstem 18, and another part of the lower portion 32 engages the upper end 28 of the downstem. In some embodiments, the entire distal portion 32 fits into the down stem so that the shoulder 36 engages the upper opening 30.

A typical downstem 18 has a length within the range of about 2" to about 6", and an inner diameter within the range of about 10 mm to about 20 mm, with variations outside these ranges for manufacturing tolerances, and with shorter, longer, narrower, and wider downstems also being available. Thus, in some embodiments the lower portion 32 of the vaporizing apparatus 10 may have a length within the range of about 1" to about 5", and an outer diameter within the range of about 9.5 mm to about 19.5 mm, with variations outside these ranges for manufacturing tolerances and certain preferences. The vaporizing apparatus 10 is thus configured to be compatible with off-the-shelf water pipes that are manufactured according to industry standards. However, it should be understood that the present embodiments are not limited by any of the dimensions specified herein.

Applicant's copending U.S. application Ser. No. 14/658,091, filed Mar. 13, 2015 and entitled, "APPARATUS AND METHODS FOR VAPORIZING ESSENTIAL OILS AND WAXES", further describes some embodiments of vaporizer technology and structure. The entirety of this copending application is hereby incorporated by reference.

With continued reference to FIG. 1, the illustrated vaporizer 10 includes a power wand receiver 40 formed on a side of the housing 31 in the proximal portion 34. Also, a lid 38, or carb cap, can be releasably attached to the proximal end of the housing 31.

Figure 2:
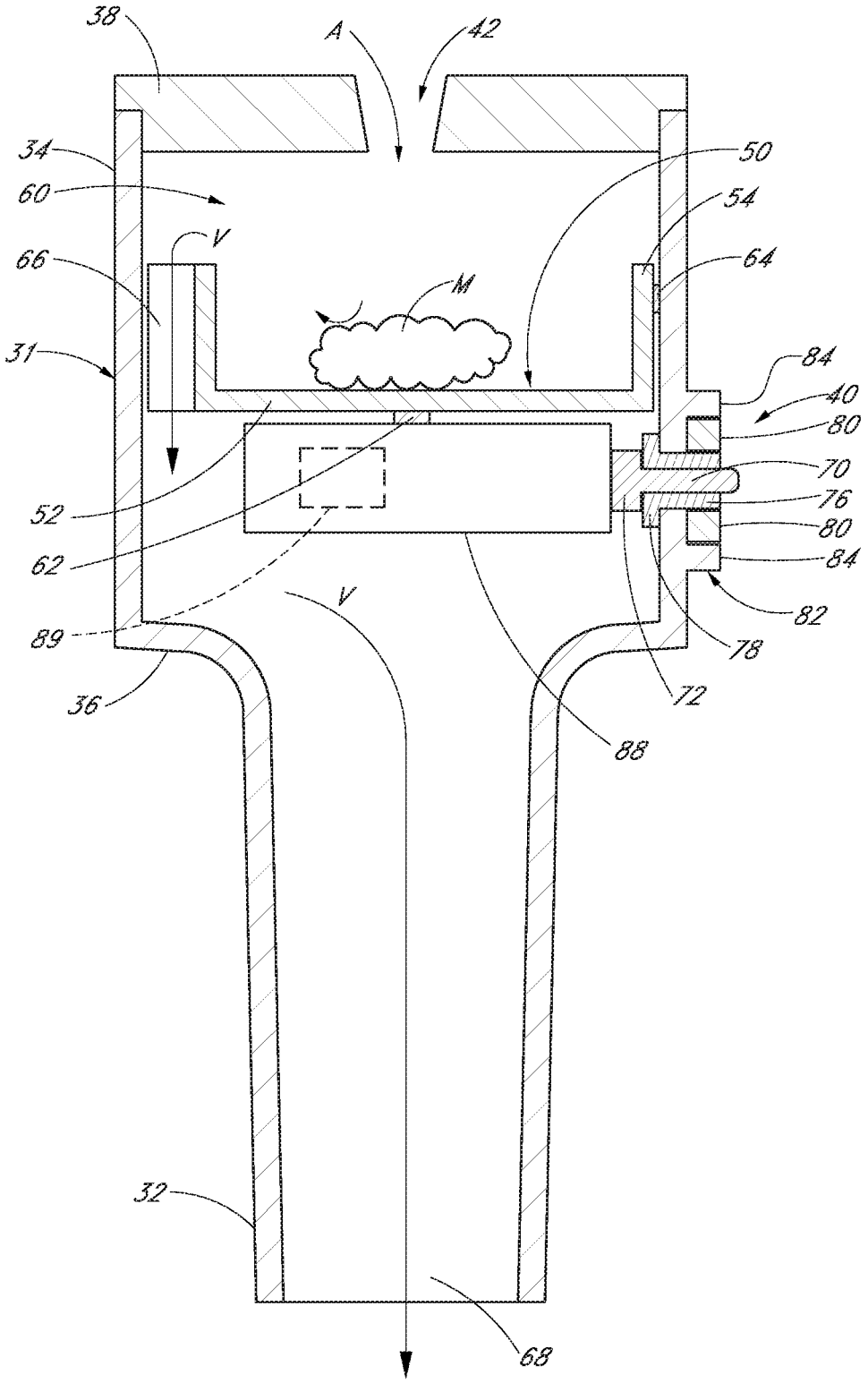
FIG. 2 is a cross-sectional view of an embodiment of a vaporizer.

FIG. 2 presents a cross-sectional view of the vaporizer 10 depicted in FIG. 1 taken along lines 2-2. In the illustrated embodiment, the removable lid 38 is arranged at the proximal end of the housing 31. The illustrated lid 38 has an inlet 42 formed therethrough so that ambient air A can be drawn into the housing 31. An atomizer cup 50 is arranged in the proximal portion 34 of the housing 31. The atomizer cup 50 includes a cup bottom wall 52 and a cup side wall 54. The atomizer cup 50 is configured to receive a vaporizing medium M such as a combustible oil, e-liquid or wax therein. A vaporizing chamber 60 is defined between the cup bottom wall 52 and the lid 38.

In the illustrated embodiment, the atomizer cup 50 is constructed of a ceramic material and has a heating element (not shown) encased therewithin. In a preferred embodiment, the heating element comprises a resistance wire that heats when subjected to an electrical current. A first end of the resistance wire terminates at a first wire pole 62 that extends from the cup bottom wall 52. A second end of the resistance wire terminates at a second wire pole 64 that extends from the cup side wall 54. As such, when electric power is applied across the first and second wire poles 62, 64, the heating element wire is energized, heating the atomizer cup 50, and correspondingly atomizing any vaporizing medium M within the cup. Such atomized medium becomes entrained in air A flowing within the vaporizing chamber 60, forming a vapor V. The illustrated atomizer cup 50 includes an exit passage 66, which provides a passage for vapor to pass from the vaporizing chamber 60 distally past or through the cup 50 into the housing 31 and eventually out of an outlet 68 at the distal end 32 of the housing 31.

As noted above, a power wand receiver 40, or power supply receiver, is provided at a side wall in the proximal portion 34 of the housing 31. The illustrated power wand receiver 40 includes an elongated vaporizer pin 70 that extends from a pin base 72 to a pin tip 74 and is electrically conductive. A vaporizer insulator 76 surrounds the vaporizer pin 70 and is electrically nonconductive. Both the vaporizer pin 70 and insulator 76 extend through an aperture formed in the housing 31. The illustrated vaporizer insulator 76 includes a flange 78 that engages an inner surface of the housing 31. The insulator 76 electrically insulates the vaporizer pin 70 from the housing 31 which, in the illustrated embodiment, is electrically conductive. A ring-shaped receiver magnet 80 is attached to the outer surface of the housing 31 adjacent the vaporizer insulator 76. A raised portion 82 of the housing 31 encircles the receiver magnet 80 and defines a seat surface 84.

In the illustrated embodiment, the vaporizer pin tip 74 extends outwardly a distance relative to the vaporizer insulator 76, receiver magnet 80 and seat surface 84. The pin 70 in this embodiment comprises a first electrical node. The seat surface 84 in this embodiment comprises a second electrical node. The pin base 72 engages a connector member 88 that is electrically conductive and is engaged with the first pole 62 of the heating element. The second pole 64 of the heating element is engaged with the inner surface of the housing 31. As such, an electrical path is defined from the pin tip 74, or first node, through the heating element via the first and second poles 62, 64 to the housing 31, and further to the seat surface 84 or second node. In some embodiments, and insulative and/or decorative skin may be applied to the outer surface of the housing 31 except in the receiver 40.

In the illustrated embodiment, the connector member 88 is shown schematically. It is to be understood that the connector member can have any of several structures, ranging from as simple as a wire to a conductive one-way valve to a circuit board having complex control circuitry. Further, the illustrated atomizer cup 50 includes a heating element encased therewithin. However, in other embodiments, the atomizer cup may include a separately-formed heating element arranged therein. For example, in one embodiment, one or more exposed wire coils, each of which may communicate with the first and second nodes via various electrical structures such as wires, may be arranged within the atomizer cup.

In one preferred embodiment, the vaporizer 10 includes no electronic controls. As such, when power is applied between the first and second nodes, the heating element is energized, and the temperature to which the atomizer cup is heated is largely dependent upon the condition of the supplied power. In some embodiments, however, a controller 89 can be provided, such as within the connector member 88 or supported by other structures of the vaporizer. The controller 89 may employ various strategies and electronic componentry to control the time that the heating element is energized, the temperature of the atomizer cup, or the like as are described in embodiments discussed in copending application Ser. No. 14/658,091, which is incorporated by reference.

Figure 3:
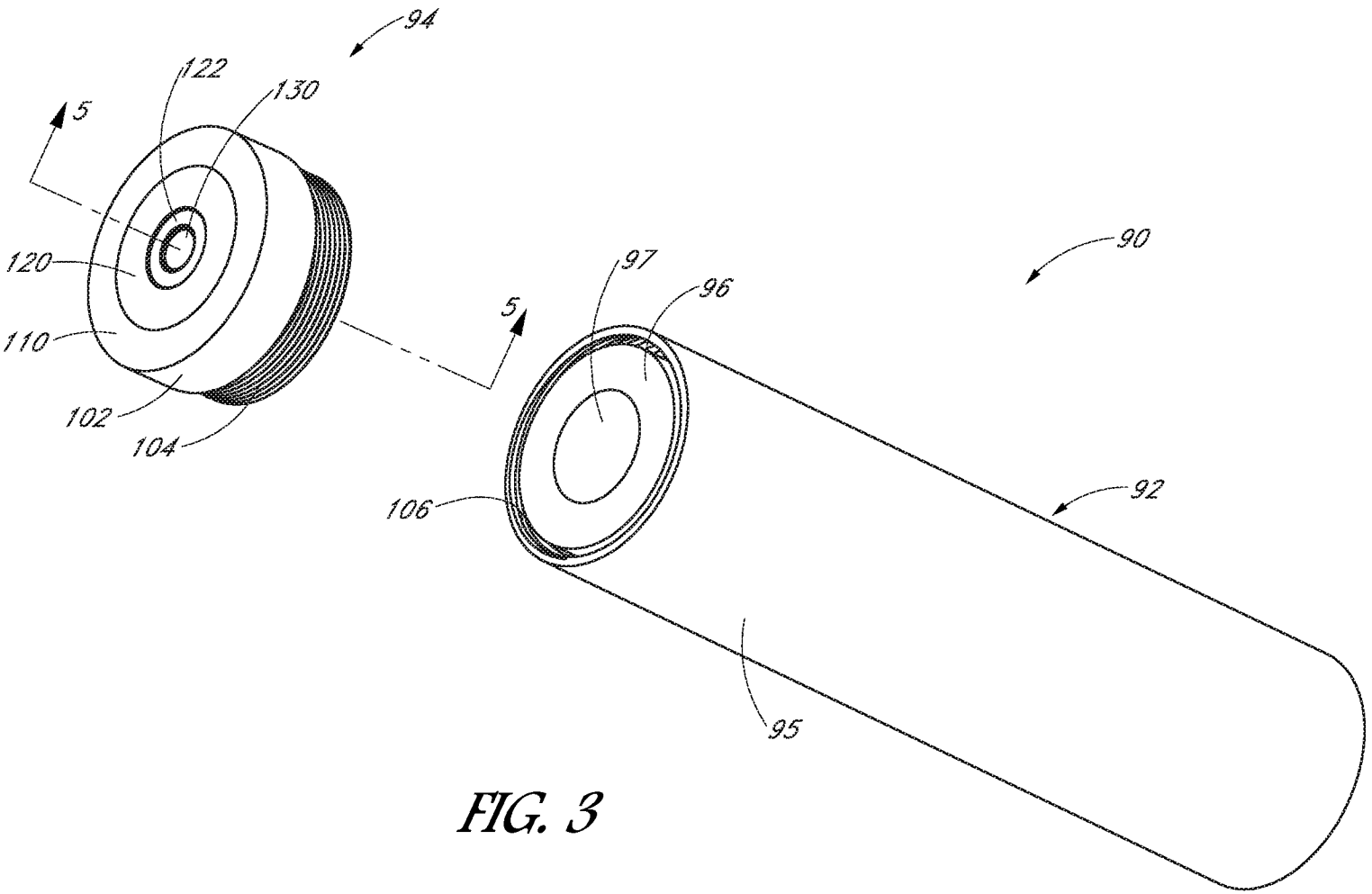
FIG. 3 is a partially exploded perspective view of a power supply in accordance with an embodiment.
Figure 4:
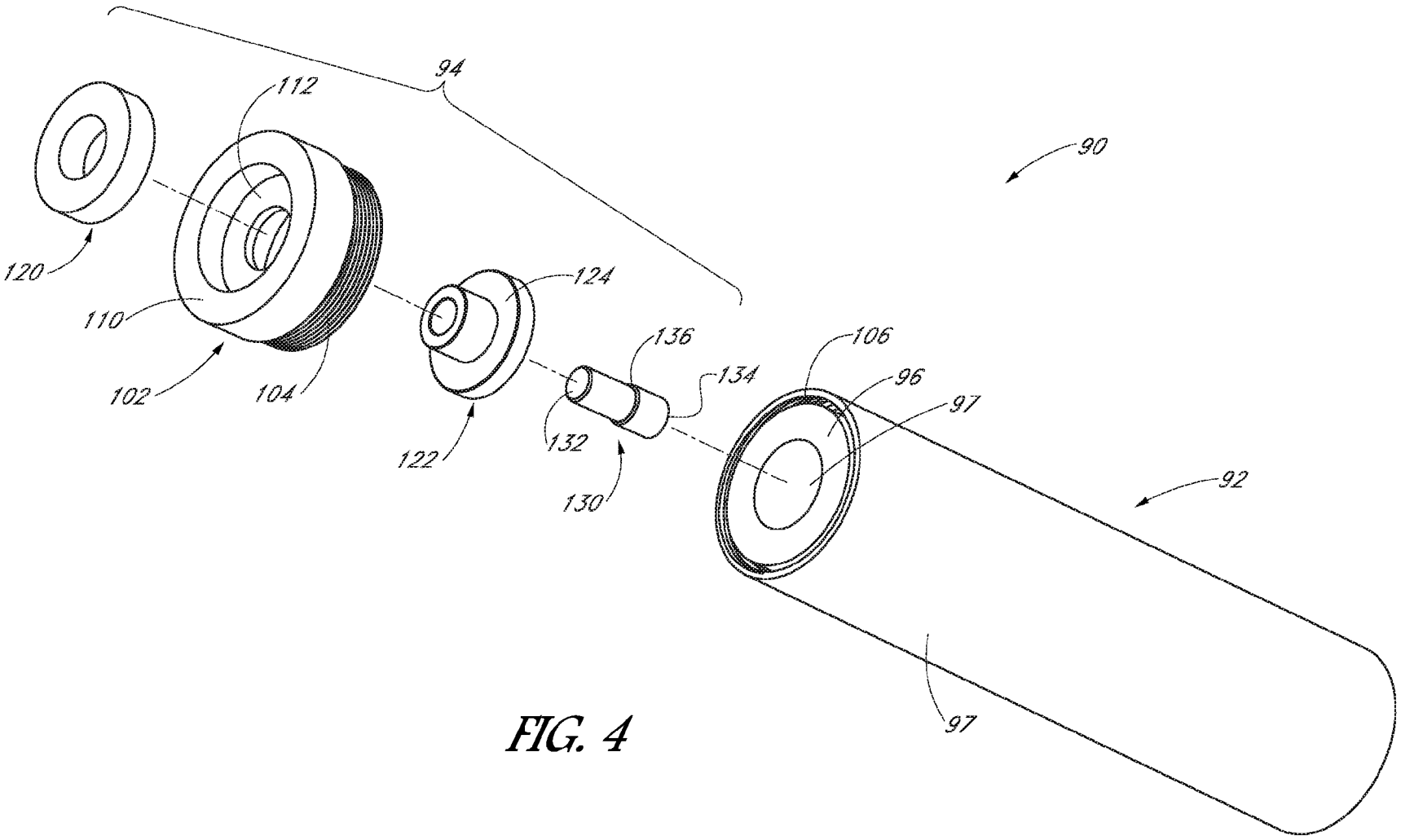
FIG. 4 is an exploded view of the power supply of FIG. 3.

With reference next to FIGS. 3 and 4, a power wand 90, or power supply, comprises a battery module 92 and a connector module 94. The battery module 92 and connector module 94 are shown separated in FIG. 3, but it is to be understood that in operation the battery module 92 and connector module 94 are connected to one another. In further embodiments, the battery module 92 and connector module 94 can be a single piece or can share a single case.

Figure 8:
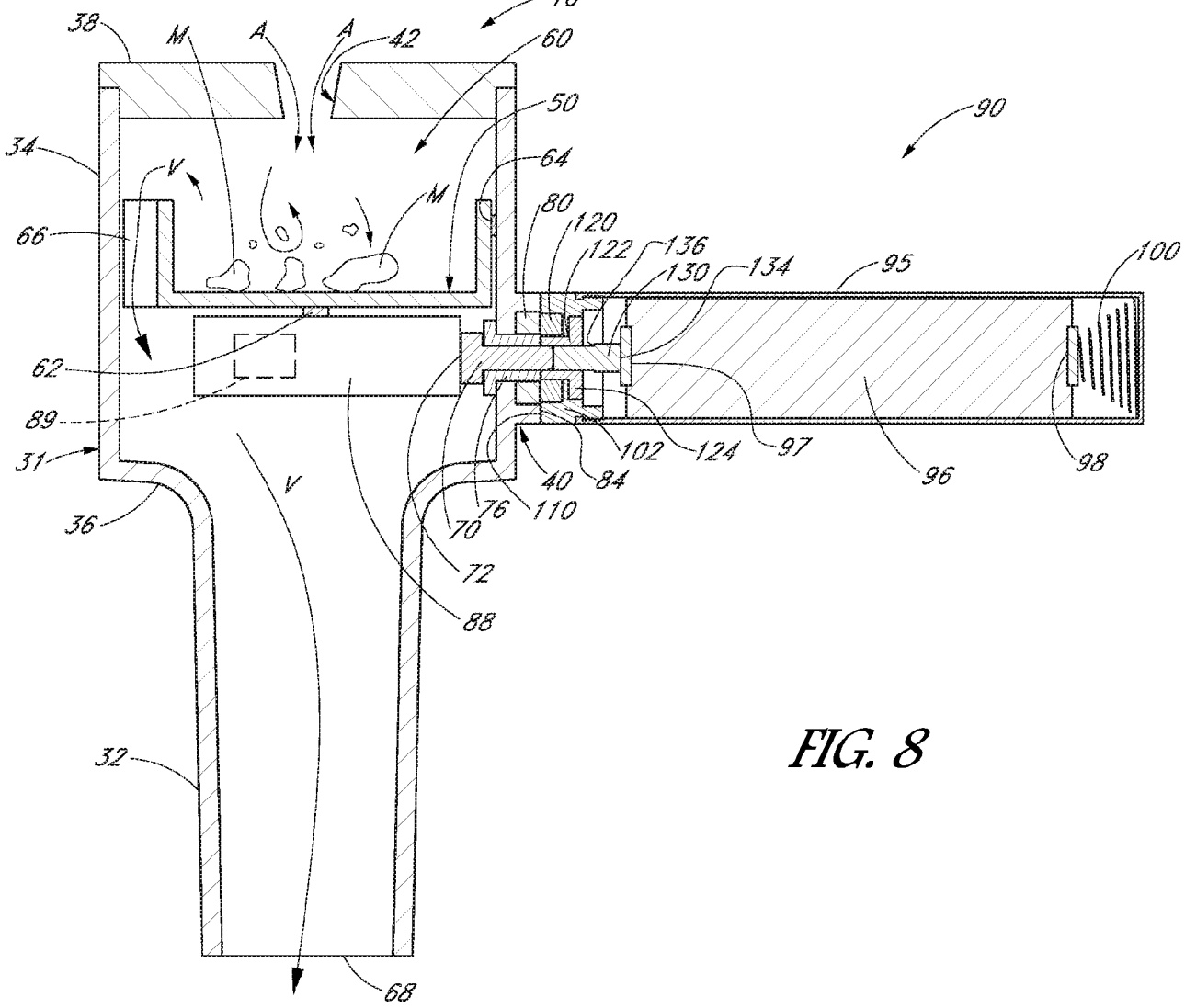
FIG. 8 is a cross-sectional view taken along line 8-8 of FIG. 7.

With continued reference to FIGS. 3 and 4, and additional reference to FIG. 8, the battery module 92 preferably comprises an electrically conductive case 95 that encloses a battery 96 that can, in some embodiments, be spring-loaded so that the battery 96 is biased proximally. A first battery pole 97 is provided centrally in a proximal end of the battery 96. A second battery pole 98 electrically has opposite polarity to the first battery pole 97, and communicates with the case 95 via a spring 100 so that the case 95 has the same polarity as the second battery pole 98.

Figure 5:
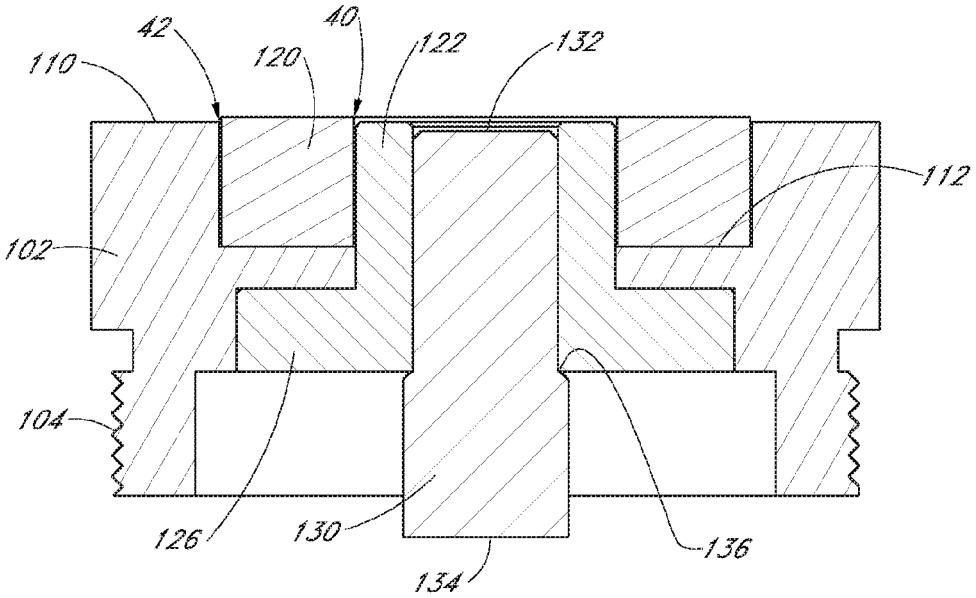
FIG. 5 is a cross-sectional view of a connector of a power supply taken along line 5-5 of FIG. 3.
Figure 6:
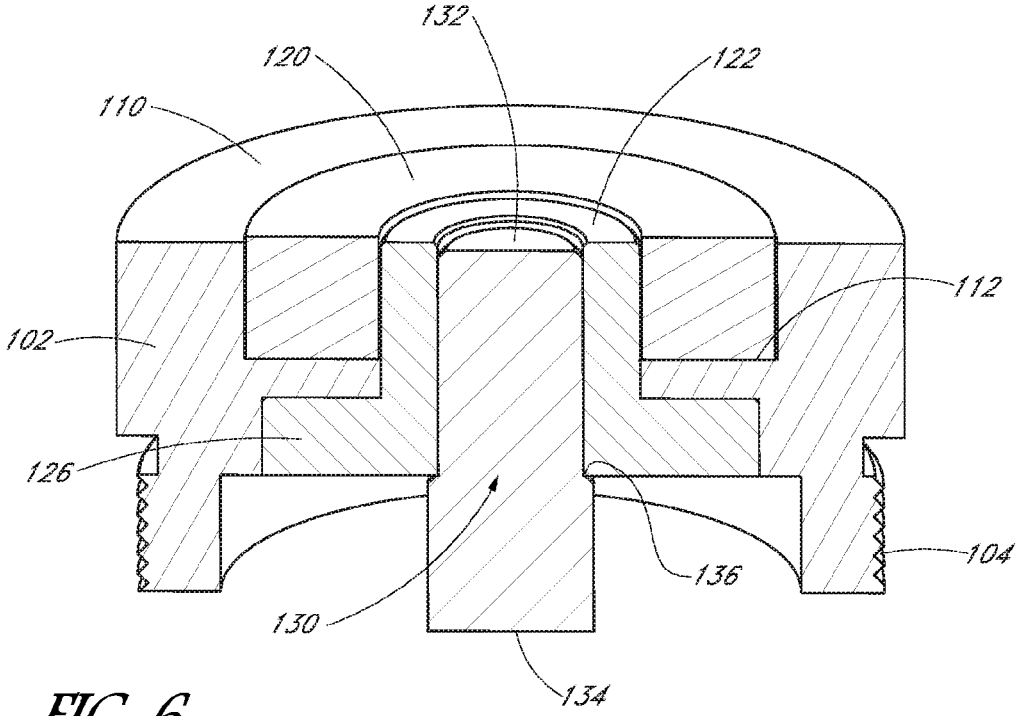
FIG. 6 is a perspective view of the connector of FIG. 5.

With additional reference to FIGS. 5 and 6, which are cross-sections taken along lines 5-5 of FIG. 3, the connector module 94 comprises a wand connector case 102 having distal threads 104 at its distal end, which distal threads 104 are configured to engage proximal threads 106 at the proximal end of the battery case 95. An engagement surface 110 of the wand connector case 102 is defined at its proximal end. Preferably, the connector case 102 is constructed of an electrically conductive material so as to electrically communicate with the second battery pole 98 via the conductive battery casing 95.

A wand magnet seat 112 is defined by the wand connector case 102, and a disk shaped wand magnet 120 is supported thereupon, preferably being held in place by the wand connector case 102. The wand magnet 120 preferably has a polarity opposite that of the receiver magnet 80, and thus is attracted to the receiver magnet. The wand magnet 120 has an aperture through which an insulator sleeve 122 extends. A radially outwardly-extending flange 124 of the insulator sleeve 122 engages an opposing side of the wand magnet seat 112. An elongated wand pin 130 is positioned within an aperture formed in the insulator sleeve 122 so that the wand pin 130 is electrically insulated from the wand connector case 102. A proximal tip 132 of the pin 130 is thus arranged centrally in the proximal end of the connector module 94. A distal end or base 134 of the pin 130 extends distally out of the insulator sleeve 122, and preferably extends distally of the distal end of the wand connector case 102. As such, the pin distal end 134 engages the first battery pole, which is biased into connection with the pin.

In the illustrated embodiment, a ridge 136 is formed on the wand pin 130 between the pin proximal tip 132 and the base 134 so that the base has a greater diameter than the proximal tip. The ridge 136 is configured to engage the insulator sleeve 122 to prevent the pin 130 from being pushed proximally through the insulator sleeve 122. In the illustrated embodiment, the battery 96 is biased proximally against the distal end 134 of the pin 130. Thus, the biased battery 96 urges the pin ridge 138 into contact with the insulator sleeve 122. In this configuration, the conductive wand pin 130 electrically communicates with the first battery pole 97 and the wand engagement surface 110 electrically communicates with the second battery pole 98. Further, the pin 130 and the engagement surface 110 are electrically insulated from one another.

Figure 7:
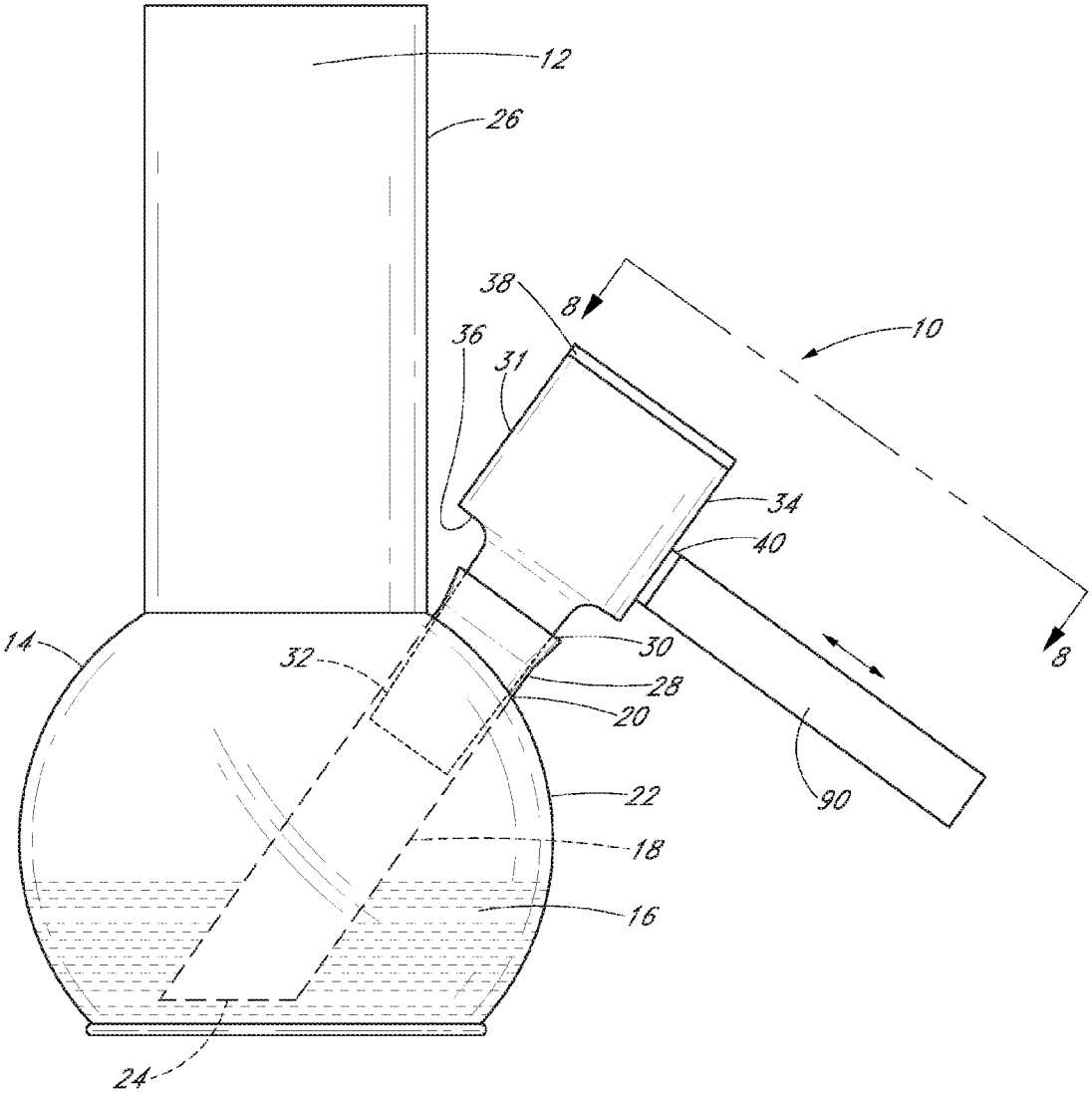
FIG. 7 is a side view of the arrangement of FIG. 1 having a power supply attached to the vaporizer.

With reference next to FIGS. 7 and 8, the power wand 90 can be engaged with the vaporizer wand receiver 40 in order to complete a circuit and energize the vaporizer heating element so as to trigger atomizing of any vaporizing medium within the atomizer cup 50. As best shown in FIG. 8, when the proximal end of the power wand 90 is brought into proximity with the wand receiver 40, the receiver magnet 80 and wand magnet 120, which have opposing polarity, attract one another to naturally align the wand pin 130 and vaporizer pin 70 and draw the pin tips into contact with one another. In this action, the engagement surface 110 of the power wand 90 is also aligned with and brought into engagement with the seat 84 of the receiver 40. With the magnets engaged, the pins are held tightly against one another, the engagement surface and the seat are held tightly against one another, and the power wand is maintained in such a position on the wand receiver of the vaporizer.

In the illustrated embodiment, engagement of the power wand 90 with the wand receiver 40 also completes the power circuit, and current flows from the first pole 97 of the battery 96 through the wand and vaporizer pins 130, 70 and to the heating element and further from the heating element through the housing 31 to and through the seat 84 and the engagement surface 110 to the second pole 98 of the battery 96. As such, engaging the power wand 90 with the wand receiver 40 provides electric power to energize the heating element, and thus a vaporizing medium M within the atomizer cup is heated and atomized. If the vaporizer is disposed with its lower or distal portion in the downstem 18 of a water pipe 12, and a user draws a breath through the pipe while the heating element is energized, ambient air A is drawn through the inlet 42 into the vaporizing chamber 60 where it is mixed with atomized medium M. Atomized medium M becomes entrained with the air A, forming a vapor V. The vapor V is drawn through the exit passage(s) 66 into and through the housing 31 and out of the outlet 68. Vapor V that flows out of the outlet 68 enters the downstem 18 of the water pipe 12 and is drawn through the pipe, eventually being delivered to the user.

In one embodiment, the heating element is energized for as long as the power wand is engaged with the wand receiver, and the only on/off control comprises the user attaching and detaching the power wand from the wand receiver. In additional embodiments, the vaporizer includes a controller that limits the time that the heating element is energized before it is automatically turned off, regardless of whether the power wand has been removed. The controller can also have other roles, such as conditioning an input power and controlling power delivery across the heating element to control the maximum temperature, control a routine for how quickly the temperature rises, how long the heating element remains energized, and the like. In some such embodiments, the controller is not accessible or modifiable by a user. In additional embodiments, the vaporizer can include a housing display and/or interface through which a user can program or select options provided by the controller. In still other embodiments, a button can be provided extending through the housing of the vaporizer and configured to interact with a controller so as to allow a user to control the vaporizer via the button. For example, in such embodiments the heating element is not automatically energized when the power wand is applied, and instead actuation of the button on the vaporizer triggers energization of the heating element.

In still other embodiments, in addition to or instead of a controller being disposed in the vaporizer, a controller and/or button as discussed above can be arranged in the power wand. Such a controller can be configured to be used to accomplish all the options as discussed above in connection with the vaporizer. In still further embodiments, the power wand can employ a user interface for selecting various options such as energizing time, temperature, operating modes, or the like. In some such embodiments, the vaporizer has no controller.

In some embodiments, a controller can be supplied in both the vaporizer and the power wand. When the power wand is attached to the vaporizer, information can be exchanged so that the power wand recognizes a particular model of vaporizer and applies or controls power delivery optimized for that particular model of vaporizer. In such embodiments, a single power wand can be employed to work with many different types and models of vaporizer, and can be configured to provide customized power delivery to each different type of vaporizer. In still further embodiments, the power wand 90 may include electrical controls but the vaporizer 10 includes simple connections and no controls.

As just discussed, it is contemplated that various control features can be accomplished in additional embodiments, including control features that involve interaction with various sensors, and including all of the control features, structures and aspects as discussed in Applicant's copending application Ser. No. 14/658,091, which is incorporated by reference.

In the illustrated embodiment, when the power wand 90 is engaged with the wand receiver 40 as shown in FIG. 8, the vaporizer pin 70, urges the proximally-biased wand pin 130 distally. For example, in FIG. 8, the wand pin 130 has been urged distally so that the pin ridge 136 is spaced from the insulator sleeve 122 and the biasing spring 100 is compressed. As such, there is reliable electrical contact between the vaporizer pin and wand pin. Also, in this configuration the vaporizer pin is partially inserted into power wand structure, strengthening a mechanical connection between the vaporizer and the power wand. In additional embodiments, the vaporizer pin can be spring-biased instead of or in addition to the wand pin being spring-biased. In still further embodiments, one or more of the seat, engagement surface, and magnets can be spring-biased instead of or in addition to the pin(s).

With specific reference again to FIGS. 5 and 6, in the illustrated embodiment, the wand magnet 120 extends proximally a slight distance from both the engagement surface 110 and the insulator sleeve/pin proximal tip. More specifically, a first axial space 140 is defined between the proximal face of the wand magnet 120 and the proximal end of both the insulator sleeve 122 and the pin proximal tip 132, and a second axial space 142 is defined between the proximal face of the wand magnet 120 and the engagement surface 110. In some embodiments, an axial space complementary to the second axial space is defined between the receiver magnet and the seat so as to facilitate connection of the wand and receiver magnets and also the seat and the engagement surface. In further embodiments, the receiver magnet may extend distally relative to the seat and the wand magnet may be placed so that the wand magnet and wand engagement surface are arranged complementary to the receiver magnet and seat. In further embodiments, the surfaces of each magnet and its adjacent seat or engagement surface are substantially coplanar. In additional embodiments, one or more of the wand and receiver magnets can be mounted so as to have some play so that the magnets fully engage one another, but the spring-biased connectors still urge both the seat and the engagement surface into tight engagement and the vaporizer and wand pin into tight engagement so as to facilitate good and consistent electrical communication and mechanical engagement through the engaged surfaces.

It is to be understood that several different specific structures can employ aspects discussed herein. For example, in additional embodiments, only one or the other of the wand pin and wand receiver may employ a magnet, with the structure without the magnet including a material to which the magnet will be drawn. Also, in additional embodiments, each of the power wand and wand receiver may include multiple pins, with first and second pins communicating with the first and second poles, respectively, of the battery.

It is also to be understood that various battery configurations can be employed. For example, some embodiments may employ typical AA or AAA batteries enclosed within the case. In additional embodiments, the battery module comprises a rechargeable battery. Some such embodiments can also include a battery charger into which the power wand may be placed in order to charge the battery. Such a battery charger may interact with the power wand through a wand receiver having structure similar to the wand receiver of the vaporizer housing as discussed above.

In still additional embodiments, the power wand may not include a battery, but may be wired to receive power from a standard wall plug connection. In such embodiments, the power wand may have power conditioning circuitry therewithin to control the power delivered to the vaporizer.

In yet further embodiments, rather than the battery and/or vaporizer casings being constructed of an electrically-conductive material, conductive paths, such as conductive traces, can be formed thereon. Still further embodiments may employ conductors such as wires.

In still further embodiments, different types of vaporizers, including table-top vaporizers or personal, mobile vaporizers, can be configured to receive power via a power wand having aspects of any of the embodiments discussed herewithin.

In yet additional embodiments, the water pipe itself may have a structure for releasably holding the power wand. In still additional embodiments, the water pipe may have a structure for accommodating the power wand recharger.

The embodiments of vaporizing apparatus and power delivery apparatus discussed herein provide numerous advantages. For example, embodiments of the present vaporizing apparatus are sized and configured to be used with typical, or "off-the-shelf," water pipes. Further, the user doesn't need to operate a handheld blowtorch in order to produce the heat necessary to vaporize the combustible material. Further, the heating surface is advantageously recessed within the vaporizing apparatus, thereby reducing the likelihood that a user will inadvertently touch the hot heating surface.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A vaporizing apparatus, comprising:

a tubular housing having a proximal end and a distal end, an access opening at the proximal end, a vapor outlet at the distal end;

an atomizer cup arranged within the housing, the atomizer cup comprising a heating element and opening toward the proximal end of the housing so as to be accessible via the access opening, the heating element having a first end and a second end;

a vapor path defined within the housing and extending distally from the atomizer cup to the vapor outlet at the distal end;

a power source receiver arranged on the housing, the power source receiver having a first node and a second node that are electrically insulated relative to one another, the first node electrically connected to the first end of the heating element and the second node electrically connected to the second end of the heating element, the power source receiver additionally comprising a magnet; and a power wand comprising a battery and a wand connector, the wand connector having a first wand node, a second wand node, an insulator electrically insulating the first wand node relative to the second wand node, and a wand magnet having a polarity opposite a polarity of the power source receiver magnet, the first wand node electrically communicating with a first pole of the battery, the second wand node electrically communicating with a second pole of the battery, the first and second poles having opposite polarity;

wherein the wand connector is configured to fit complementarily onto the power source receiver so that the power source receiver magnet and the wand magnet hold the wand connector in place on the power source receiver so that the first wand node engages the first node and the second wand node engages the second node;

wherein when the wand connector is fit onto the power source receiver, the heating element is energized.

2. A vaporizing apparatus as in claim 1, wherein the power source receiver is formed on a side wall of the vaporizer housing.

3. A vaporizing apparatus as in claim 1, wherein a tapered part of the housing has a tapered outer diameter that decreases moving toward the distal end of the housing.

4. A vaporizing apparatus as in claim 3, wherein a proximal portion of the housing has an outer diameter greater than an outer diameter of a distal portion of the housing, and the tapered part is in the distal portion of the housing.

5. A vaporizing apparatus as in claim 1 additionally comprising a controller, the controller configured to control power delivery to the heating element.

6. A vaporizing apparatus as in claim 5, wherein the controller is configured to prevent energizing of the heating element beyond an elapsed time.

7. A vaporizing apparatus as in claim 5 additionally comprising a lid (carb cap) configured to be removably attached to the proximal end of the housing so as to at least partially close the access opening and to define a vaporizing chamber between the lid and a bottom surface of the atomizer cup when the lid is attached.

8. A vaporizing apparatus as in claim 5, wherein the controller is disposed within the power wand and a vaporizer controller is disposed within the vaporizer housing, and the vaporizer controller communicates information to the controller when the power wand is connected to the vaporizer, and wherein the controller controls power delivery based in part upon the information.

9. A vaporizing apparatus as in claim 5, wherein the controller is configured so that a user can select between a plurality of control modes by actuating an interface.

10. A vaporizing apparatus as in claim 9, wherein the controller is disposed within one of the vaporizer and power wand.

11. A vaporizing apparatus as in claim 9, wherein the interface comprises an actuator button, and wherein in a first mode the controller is configured to energize the heating elements for a specified time period when the actuator button is actuated.

12. A vaporizing apparatus as in claim 4, configured for use in connection with a water pipe having a downstem with a downstem inner diameter, wherein a first portion of the tapered part has a diameter less than the downstem inner diameter and a second portion of the tapered part has a diameter greater than or equal to the downstem inner diameter, wherein the tapered part engages an inner surface of the downstem and some of the tapered part extends into the downstem.

13. A vaporizing apparatus as in claim 12, wherein the power source receiver is formed on a side of the vaporizer housing in the proximal portion of the vaporizer housing.

14. A method of using a vaporizing apparatus, comprising:

placing a vaporizing medium on a heating surface of an atomizer cup arranged in a tubular housing of the vaporizing apparatus;

placing the vaporizing apparatus into a downstem of a water pipe so that a distal portion of the tubular housing of the vaporizing apparatus extends into the downstem and an engagement part of the distal portion of the tubular housing engages an inner surface of the downstem, while a proximal portion of the tubular housing is suspended above the downstem, the atomizer cup being within the proximal portion and opening toward a proximal access opening at a proximal end of the tubular housing;

engaging a separately-formed power wand with a wand receiver formed on the proximal portion of the tubular housing so that electric power from the power wand is communicated to the heating surface of the atomizer cup; and drawing a vapor along a vapor path that extends distally from the heating surface, through the proximal and distal portions of the tubular housing and into the downstem, and further through the water pipe.

15. A method as in claim 14, wherein intake air is drawn through the proximal access opening.

16. A method as in claim 14, wherein electric power begins being delivered from the power wand to the heating surface automatically upon engagement of the power wand with the wand receiver.

17. A method as in claim 16, additionally comprising leaving the power wand engaged with the wand receiver, and a controller automatically stops delivery of power to the atomizer cup after a specified time.

18. A vaporizing apparatus, comprising:

a tubular housing having a proximal end, a distal end, and a housing axis extending between the proximal end and the distal end;

an atomizer cup arranged within the housing, the atomizer cup comprising a heating element and opening toward the proximal end of the housing, the heating element having a first end and a second end;

a flow path defined within the housing, the flow path extending from an air inlet to a vapor outlet and communicating with the atomizer cup;

a power source receiver arranged on a side wall of the housing, the power source receiver having a first node and a second node that are electrically insulated relative to one another, the first node electrically connected to the first end of the heating element and the second node electrically connected to the second end of the heating element, the power source receiver additionally comprising a magnet; and a power wand comprising a battery and a wand connector, the wand connector having a first wand node, a second wand node, an insulator electrically insulating the first wand node relative to the second wand node, and a wand magnet having a polarity opposite a polarity of the power source receiver magnet, the first wand node electrically communicating with a first pole of the battery, the second wand node electrically communicating with a second pole of the battery, the first and second poles having opposite polarity;

wherein the wand connector is configured to fit complementarily onto the power source receiver so that the power source receiver magnet and the wand magnet hold the wand connector in place on the power source receiver so that the first wand node engages the first node and the second wand node engages the second node;

wherein when the wand connector is fit onto the power source receiver, the heating element can be energized by power from the power wand.

19. A vaporizing apparatus as in claim 18, wherein when the power wand is connected to the vaporizer, no part of the power wand intersects the flow path.

20. A vaporizing apparatus as in claim 19, wherein the power wand has a wand axis, and when the power wand is connected to the vaporizer, the wand axis is transverse to the housing axis.

21. A vaporizing apparatus as in claim 18, wherein the vapor outlet is disposed at the distal end of the vaporizer housing.

22. A vaporizing apparatus as in claim 21, configured for use in connection with a water pipe having a downstem, wherein a distal portion of the vaporizer housing fits within the downstem and the vaporizer housing engages and is supported by the downstem so that a proximal portion of the vaporizer housing extends from the downstem, wherein the inlet opening is in the proximal portion and the power source receiver is in the proximal portion.

* * * * *